United States Patent [19]

Kulle et al.

[11] 4,190,171

[45] Feb. 26, 1980

[54] CLOSURE WITH COMPENSATING THREADS

[75] Inventors: Lee K. Kulle, Mundelein; William L. Rudzena, McHenry, both of Ill.

[73] Assignee: Baxter Travenol Laboratories, Inc., Deerfield, Ill.

[21] Appl. No.: 9,388

[22] Filed: Feb. 2, 1979

[51] Int. Cl.[2] ..... B65D 41/04

[52] U.S. Cl. ..... 215/329; 220/288; 215/318

[58] Field of Search ..... 215/329, 318; 220/288; 85/35, 41, 46, 1 R; 151/22

[56] References Cited

U.S. PATENT DOCUMENTS

| | | | |
|---|---|---|---|
| 197,466 | 11/1877 | Harvey | 151/22 |
| 704,482 | 7/1902 | Livingstone | 215/329 |
| 2,075,411 | 3/1937 | Von Mertens | 85/44 |
| 3,189,072 | 6/1965 | Starr | 220/288 |
| 3,263,850 | 8/1966 | Scott | 215/329 |
| 3,487,442 | 12/1969 | Rossmann | 85/46 |
| 3,589,550 | 6/1971 | Rossmann | 220/288 |
| 3,640,416 | 2/1972 | Temple | 215/329 |
| 4,014,452 | 3/1977 | Galer | 220/288 |

FOREIGN PATENT DOCUMENTS

| | | | |
|---|---|---|---|
| 2323561 | 11/1974 | Fed. Rep. of Germany | 215/329 |
| 2412439 | 9/1975 | Fed. Rep. of Germany | 215/329 |
| 226844 | 6/1968 | Sweden | 215/329 |
| 461972 | 10/1968 | Switzerland | 215/329 |
| 1082440 | 9/1967 | United Kingdom | 215/329 |

*Primary Examiner*—Ro E. Hart

*Attorney, Agent, or Firm*—Paul C. Flattery; John P. Kirby, Jr.; George Gerstman

[57] ABSTRACT

A container closure is provided with internal threads which compensate for variations in the external threads of a container neck onto which the container closure is to be threaded. The container closure threads extend inwardly toward the central axis of the closure and, in the illustrative embodiment, define an angle of 30 degrees with respect to the central axis. The closure thread tapers inwardly as it extends toward the central axis and is generally flexible but is sufficiently rigid to prevent the lower thread from contacting an immediately higher thread during flexing of the threads.

7 Claims, 2 Drawing Figures

CLOSURE WITH COMPENSATING THREADS

BACKGROUND OF THE INVENTION

This invention concerns a container closure having threads which are configured to allow for a great variation in the mating thread.

Molded plastic containers are in extremely wide use today, with many of the containers having an externally threaded neck which is adapted to mate with the internal threads of a container closure. It has been found that substantial variations exist in the parameters of the external threads of blow-molded containers. On some occasions, the expansion of the neck may have been larger than desired and the threads have a particular pitch and configuration while in other instances the expansion of the neck may be smaller than desired and the external threads have a significantly different pitch and configuration from the previously described threads.

When the container closure, which may have been injection molded, is attempted to be threaded onto the neck of the container, the substantial variation in the container neck thread parameters sometimes results in the inability of the closure to be threaded onto a container neck. An excessive tightness between the closure and the container may occur if the container neck is too large. An excessive looseness may occur between the closure and the container neck, particularly if the container neck is too small, thereby resulting in shifting of the closure with respect to the container neck. If the closure is too tight with respect to the container, the operator may experience difficulty in turning the closure and particles may be generated. On the other hand, if the closure is too loose with respect to the container, the closure may fall off and/or leakage may result.

In order for the neck of the container to have precise dimensions, an unusually expensive operation would be required. Such an expensive operation is not always feasible and yet it is desirable to have a properly mating container closure and container.

It is, therefore, an object of the present invention to provide an internally threaded closure for an externally threaded container, with the closure having a thread configuration that compensates for significant variations in the mating thread.

Another object of the present invention is to provide a container closure having compensating threads and having a configuration that is efficient to manufacture.

Other objects and advantages of the present invention will become apparent as the description proceeds.

SUMMARY OF THE INVENTION

In accordance with the present invention, a container closure is provided for threadedly engaging the externally threaded neck of a container. The closure is internally threaded along its side wall and the thread extends inwardly toward the central axis of the closure and defines an angle of less than 45 degrees with respect to the central axis. The closure thread tapers inwardly as it extends toward the central axis and is generally flexible, but is sufficiently rigid to prevent a lower thread from contacting an immediately higher thread during flexing of the threads. In this manner, the container closure may be threaded onto an externally threaded container and it will compensate for the variations in the mating thread geometry.

In the illustrative embodiment, the closure thread extends inwardly and upwardly from the closure side wall, and the thread defines an angle of 30 degrees with respect to the central axis. The thread has a distal end that is no more than two thirds in cross-sectional width than the cross-sectional width at the base of the thread and the thread is integrally molded with the closure and formed from the group of plastics consisting of propylene and ethylene.

A more detailed explanation of the invention is provided in the following description and claims, and is illustrated in the accompanying drawings.

DETAILED DESCRIPTION OF THE ILLUSTRATIVE EMBODIMENT

Figure 1:
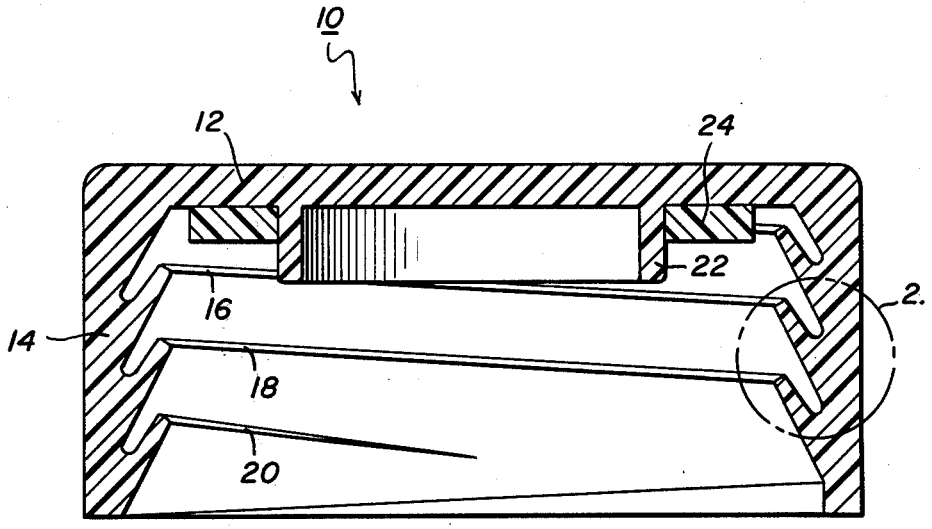
FIG. 1 is a cross-sectional elevation of a container closure constructed in accordance with the principles of the present invention.

Referring to FIG. 1, a closure cap 10 is shown having a top wall 12 with side walls 14 extending downwardly therefrom. Side walls 14 are internally threaded with a number of threads 16, 18 and 20. In the illustrative embodiment, closure 10 has 2½ full threads, although it is to be understand that more or less threads could be used as desired.

Closure 10 includes a ring 22 which extends downwardly from top wall 12 to support a silicone rubber gasket 24 which is formed as a ring tightly surrounding ring 22. Gasket 24 is located so as to provide a seal at the pour lip of the container when the closure is threaded onto the container.

Threads 16, 18 and 20 extend inwardly and upwardly and define an angle a (FIG. 2) of less than 45 degrees with respect to the central axis of the closure. In the illustrative embodiment, angle a is 30 degrees which has been found to be highly effective.

In the illustrative embodiment, the container closure has an external diameter of 1.8 inch and a height of 0.8 inch with thread pitch of six threads per inch. It is important that each of the threads be generally flexible so as to mate properly with the external threads of the container but the closure threads should also be sufficiently rigid so that when the threads are flexed, a lower thread (such as thread 18) will not contact an immediately upper thread (such as thread 16). A plastic material such as ethylene or propylene is preferably used in the formation of the closure cap, in which the top wall 12, side walls 14, threads and ring 22 are molded as a one-piece unit.

Figure 2:
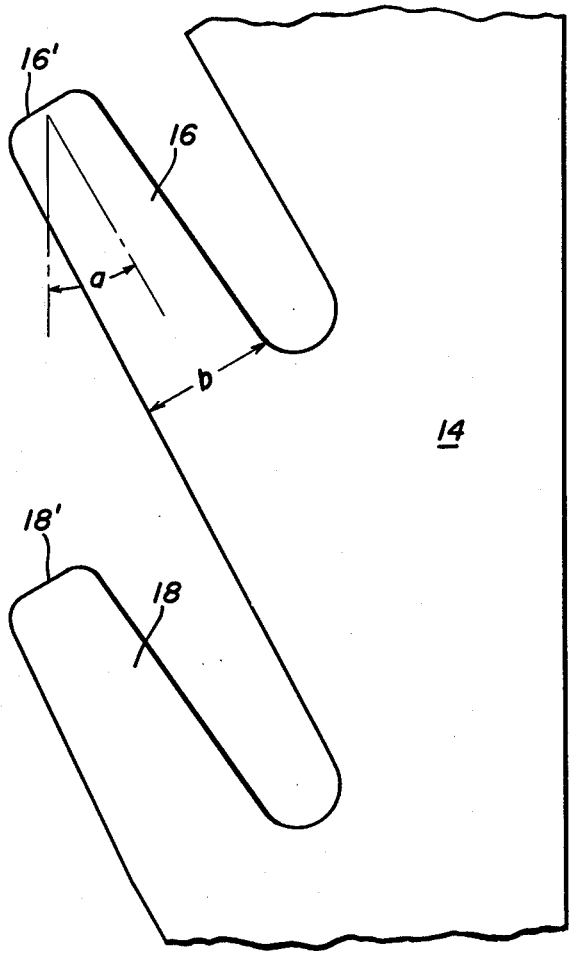
FIG. 2 is a greatly enlarged cross-sectional view of a portion of FIG. 1.

In order to provide the proper flexibility, it is desirable that each of the threads taper continuously inwardly as they extend toward the axis of the closure, as illustrated most clearly in FIG. 2. It is important that the distal end 16', 18', etc., of threads 16, 18, etc., respectively, have a cross-sectional width that is no greater than two thirds the base width b of each thread. In the illustrative embodiment, the base width b of each thread is 0.045 inch and the distal end width is no greater than 0.03 inch. The threads may be configured so that the spacing defined between the threads is the same size as the solid material comprising the threads. In other words, the spacing defined between the threads may form the reverse configuration of the threads.

A compensating thread configuration has been disclosed which allows the closure cap to mate with externally threaded containers having significant variations in the pitch diameters and also having out of round threads. By using the configuration according to the principles of the present invention, particles are not generated and the closure cap may be threaded onto the container without resulting in excessive tightness or excessive looseness.

Although an illustrative embodiment of the invention has been shown and described, it is to be understood that various modifications and substitutions may be made by those skilled in the art without departing from the novel spirit and scope of the present invention.

That which is claimed is:

1. A container closure for threadedly engaging the externally threaded neck of a container, the closure being internally threaded along its side wall, the improvement comprising:

said closure thread extending inwardly toward the central axis of the closure and defining an angle of less than 45 degrees with respect to said central axis;

said closure thread tapering inwardly as it extends toward said central axis and being generally flexible but being sufficiently rigid to prevent a lower thread from contacting an immediately higher thread during flexing of the threads;

whereby said container closure may be threaded onto an externally threaded container and it will compensate for the variations in the mating thread geometry.

2. A container closure as described in claim 1, said thread extending inwardly and upwardly from the closure side wall.

3. A container closure as defined in claim 1, said thread defining an angle of 30 degrees with respect to said central axis.

4. A container closure as described in claim 1, said thread having a distal end that is more than two thirds in cross-sectional width than the cross-sectional width at the base of the thread.

5. A container closure as described in claim 1, said thread being integrally molded with the closure and formed from the group of plastics consisting of propylene and ethylene.

6. A container closure for threadedly engaging the externally threaded neck of a container, the closure being internally threaded along its side wall, the improvement comprising:

said closure thread extending inwardly and upwardly from the closure side wall toward the central axis of the closure and defining an angle of 30 degrees with respect to said central axis;

said closure thread tapering inwardly as it extends toward said central axis and having a distal end that is no more than two thirds in cross-sectional width than the cross-sectional width at the base of the thread;

said closure thread being generally flexible but being sufficiently rigid to prevent a lower thread from contacting an immediately high thread during flexing of the threads;

whereby said container closure may be threaded onto an externally threaded container and it will compensate for the variations in the mating thread geometry.

7. A container closure as described in claim 6, said closure being formed of a softer plastic material than the plastic material that forms the threaded container neck.

* * * * *